US007595592B2

(12) United States Patent
Muto et al.

(10) Patent No.: US 7,595,592 B2
(45) Date of Patent: Sep. 29, 2009

(54) DISCHARGE LAMP AND METHOD OF MAKING SAME

(75) Inventors: Masaaki Muto, Tokyo (JP); Masatoshi Hirohashi, Tokyo (JP); Toshiyuki Nagahara, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/981,734

(22) Filed: Nov. 5, 2004

(65) Prior Publication Data

US 2005/0200279 A1 Sep. 15, 2005

(30) Foreign Application Priority Data

Mar. 10, 2004 (JP) ..... 2004-066682

(51) Int. Cl.
*H01J 61/36* (2006.01)

(52) U.S. Cl. ..... 313/623

(58) Field of Classification Search ..... 313/582–587, 313/623; 445/52
See application file for complete search history.

(56) References Cited

U.S. PATENT DOCUMENTS 5,905,338 A * 5/1999 Verspaget et al. ..... 313/623
2003/0076040 A1* 4/2003 Kumada et al. ..... 313/631

FOREIGN PATENT DOCUMENTS

| | | | |
|---|---|---|---|
| JP | 10255720 | | 9/1998 |
| JP | 11-007918 | | 1/1999 |
| JP | 2001266794 A | * | 9/2001 |
| WO | WO01/18847 | | 3/2001 |

OTHER PUBLICATIONS

English Translation of previously cited JP 10-255720 (Sep. 1998).*

* cited by examiner

*Primary Examiner*—Toan Ton
*Assistant Examiner*—Hana A Sanei
(74) *Attorney, Agent, or Firm*—Cermak Kenealy Vaidya & Nakajima LLP

(57) ABSTRACT

A discharge lamp can be configured to include a glass tube bulb; a pair of discharge electrodes arranged within the glass tube bulb; and metal foils enclosed within sealing portions at both axial ends of the glass tube bulb so as to connect the discharge electrodes and externally extending lead wires. The metal foils can be provided with cuts and/or holes of various shapes and sizes acting as a stress alleviating portion for alleviating stress due to temperature variations.

17 Claims, 14 Drawing Sheets

DISCHARGE LAMP AND METHOD OF MAKING SAME

This invention claims the benefit of Japanese patent application No. 2004-066682, filed on Mar. 10, 2004, which is hereby incorporated by reference.

BACKGROUND OF THE INVENTION

1. Field of the Invention

The invention relates to a discharge lamp such as a metal halide lamp, a halogen electric bulb, high-voltage discharge lamp or other similar lamp and, more particularly, to a discharge lamp configured by sealing metal foils within sealing portions of a bulb.

2. Description of the Related Art

Metal halide lamps are conventionally configured, for example, as shown in FIG. 13. That is, in FIG. 13, a metal halide lamp 1 comprises a hollow glass tube bulb 2, a pair of discharge electrodes 3 and 4 arranged within the glass tube bulb 2 and metal foils 7 and 8 connecting the discharge electrodes 3 and 4 to externally extending lead wires 5 and 6.

The glass tube bulb 2, made, for example, of quartz glass, is formed roughly in the form of a hollow sphere in the case of the illustration. At the same time, the glass tube bulb 2 is provided with sealing portions 2*a* and 2*b* each at an axial end, and mercury/metal halide, etc. is enclosed in the sealing portions 2*a* and 2*b* when these portions are sealed.

The discharge electrodes 3 and 4, made, for example, of a metal such as molybdenum, are arranged such that they are opposite to each other with a given spacing roughly at the center of the glass tube bulb 2.

The lead wires 5 and 6, similarly made of a metal such as molybdenum, are intended to supply power to the discharge electrodes 3 and 4 and are electrically connected to the discharge electrodes 3 and 4 via the metal foils 7 and 8. The metal foils 7 and 8, made, for example, of molybdenum foils, are sealed within the sealing portions 2*a* and 2*b* at respective ends of the glass tube bulb 2.

More specifically, with the discharge electrode 3 and 4 and the lead wires 5 and 6 connected respectively, for example, by welding, the metal foils 7 and 8 are inserted into the sealing portions 2*a* and 2*b* in an open state at both ends of the glass tube bulb 2, and then the sealing portions 2*a* and 2*b* are respectively softened by heating and crushed flatly so as to hold the metal foils 7 and 8, thus sealing the metal foils 7 and 8. This ensures hermetic sealing of the metal foils 7 and 8—portions that function as power supply portions for connecting the discharge electrodes 3 and 4 and the lead wires 5 and 6—within the sealing portions 2*a* and 2*b* of the glass tube bulb 2, thus maintaining the internal space of the glass tube bulb 2 hermetic.

Here, while the metal foils 7 and 8 have an approximately 10-fold higher thermal expansion ratio than quartz glass, the metal foils 7 and 8 are formed such that they are extremely thin, thus allowing hermetic sealing of the inside of the glass tube bulb 2.

Incidentally, in the metal halide lamp 1 thus configured, since there is a considerable difference in thermal expansion ratio between a metal such as molybdenum (which make up the metal foils 7 and 8) and quartz glass (which make up the glass tube bulb 2 as described earlier), the amount of expansion and compression due to temperature change is likely largest in the axial direction of the metal foils 7 and 8. This leads to stress concentration in longer sides extending along the axial direction of the metal foils 7 and 8.

As a result, there are times when cracks, originating from the longer sides of the metal foils 7 and 8, occur in the sealing portions 2*a* and 2*b* of the glass tube bulb 2. Cracks can prominently occur, particularly if the metal foils 7 and 8 are subjected to rough surface finish.

As a countermeasure therefore, there is disclosed in Japanese Patent Application Laid-Open Publication No. 1999-7918, a molybdenum foil glass sealing portion 9 in which axial end edges of a molybdenum foil are formed in a wedge shape as viewed in cross-section.

Based on this configuration, deformations such as burrs arising out of cutting of molybdenum foils are resolved by forming the cut edge in a wedge shape, thus suppressing the occurence of cracks, originating from longer sides of molybdenum foils, within the sealing portions of the glass tube bulb.

In the molybdenum foil glass sealing portions according to Japanese Patent Application Laid-Open Publication No. 1999-7918, however, it has been discovered that if the molybdenum foils are rough finished on their surface, it is difficult to reliably suppress the occurence of cracks originating from longer sides of the molybdenum foils within the sealing portions of the glass tube bulb. Thus, such a configuration typically results in a crack, for example, about 1.5 mm in size occurring immediately after sealing of the molybdenum foils.

In addition, repetitive flashing of the metal halide lamp 1 gives rise to cracks both in longer sides of the metal foils 7 and 8 and in the entire surrounding area, and expands already existing cracks. This is presumably caused by stress concentration not only in longer sides but also in shorter sides and corners of the metal foils 7 and 8 due to the difference in thermal expansion ratio resulting from temperature variations. In the event of expansion of such cracks, cracks reach the outer surface under certain circumstances, possibly causing mercury/metal halide, etc. that is enclosed within the glass tube bulb to leak externally.

This kind of problem is not limited to metal halide lamps and occurs in other lamps such as those including tungsten-halogen electric bulbs and high-pressure discharge lamps in which metal foils making up power supply portions are sealed within the sealing portions of the glass tube bulb.

SUMMARY OF THE INVENTION

In accordance with one of several aspects of the invention, a discharge lamp can be configured that is capable of reliably suppressing the occurence of cracks around the metal foils sealed within the sealing portions of the glass tube bulb. In accordance with another aspect of the invention a discharge lamp can be provided that includes a glass tube bulb; a pair of discharge electrodes arranged within the glass tube bulb; and metal foils enclosed within sealing portions at both axial ends of the glass tube bulb so as to connect the discharge electrodes and externally extending lead wires. At least one of the metal foils can be provided with a stress alleviating portion for alleviating stress due to temperature variations.

The stress alleviating portion can include a plurality of holes provided at least in the axial end edge regions of the metal foils. The stress alleviating portion can also be configured as a plurality of cuts provided at least along the axial end edges of the metal foils. The cuts can be provided continuously so as to be in contact with the adjacent cuts. The cuts can also be provided discontinuously so as to have a given spacing from the adjacent cuts.

The stress alleviating portion can be further located in the side edge regions extending in the axial direction of the metal foils. The stress alleviating portion can also be provided on the insides of the end and side edges of the metal foils.

At least one of the metal foils can be provided with a stress alleviating portion, thus alleviating stress, resulting from difference in thermal expansion ratio between the metal foils and the glass tube bulb, even under temperature variations. It is therefore possible to suppress the occurence of cracks originating from the side or end edges of the metal foils within the sealing portions of the glass tube bulb.

Further, stress can similarly be alleviated by the stress alleviating portion in the case of repetitive flashing of the discharge lamp over a long period of time. Thus the occurence of cracks and expansion of cracks can be minimized.

When the stress alleviating portion is configured as a plurality of holes or cuts provided at least in the axial end edge regions of the metal foils, stress in the end edge regions of the metal foils, resulting from difference in thermal expansion ratio between the metal foils and the sealing portions of the glass tube bulb, is alleviated by the stress alleviating portion made up of the holes or cuts, thus suppressing the occurence of cracks in these regions.

When the cuts are continuously arranged so as to be in contact with adjacent cuts, stress alleviation by the stress alleviating portion made up of the cuts can be more effectively carried out.

When the cuts are discontinuously arranged so as to have a given spacing from adjacent cuts, the metal foils can be readily worked on, thus alleviating the stress.

When the stress alleviating portion is also provided in the side edge regions extending in the axial direction of the metal foils, the stress is alleviated by the stress alleviating portion in the entire surrounding area of the metal foils, further suppressing the occurence of cracks.

When the stress alleviating portion is provided on the insides of the end and side edges of the metal foils, since holes serving as the stress alleviating portion are provided on the insides of the metal foils, quartz glass making up the sealing portions of the glass tube bulb melts from both sides of the metal foils through the holes and merges, thus enhancing adhesion of the metal foils to the sealing portions of the glass tube bulb and effectively suppressing the occurence of cracks even in the case of repetitive flashing over a long period of time.

Thus, the discharge electrodes and the lead wires can be connected, and the metal foils making up the hermetic power supply portions can be provided with the stress alleviating portion that includes or consists, for example, of holes or cuts. Thus, stress resulting from a difference in thermal expansion ratio between the metal foils and the glass tube bulb can be alleviated when temperature variations occur by using the stress alleviating portion. This makes it possible to suppress the occurence of cracks originating from the side or end edges around the metal foils.

On the other hand, when the stress alleviating portion is provided as holes, quartz glass, making up the sealing portions of the glass tube bulb located on both sides of the metal foils, melts and merges via the stress alleviating portion, thus enhancing adhesion of the metal foils to the sealing portions of the glass tube bulb. This makes it possible to suppress the occurence of cracks around the metal foils due to repetitive flashing of the discharge lamp over a long period of time.

In this manner, the discharge lamp can remain free from impaired sealing of the glass tube bulb or sealed gas leaks outside the glass tube bulb due to cracks, thus enhancing reliability of the discharge lamp.

In accordance with another aspect of the invention, a method for making a discharge lamp can include providing a bulb having a sealing portion located at an end of the bulb, providing a discharge electrode, and providing an externally extending lead wire and a metal foil that includes at least one of cuts on a side edge, cuts on an end edge, and holes on an inside portion of the metal foil, and sealing the discharge electrode, the lead wire and the metal foil in the sealing portion of the bulb.

BRIEF DESCRIPTION OF THE DRAWINGS

The above and other aspects, features and advantages of the present invention will become more apparent from the following detailed description when taken in conjunction with the accompanying drawings, in which.

DETAILED DESCRIPTION OF PREFERRED EMBODIMENTS

A detailed description will be given below of preferred embodiments of the present invention with reference to FIGS. 1 to 12.

It is to be noted that while the embodiments described below are specific preferred examples and are thereby subject to various technically preferred features, the scope of the invention is not limited to the embodiments in the following description.

Figure 1:
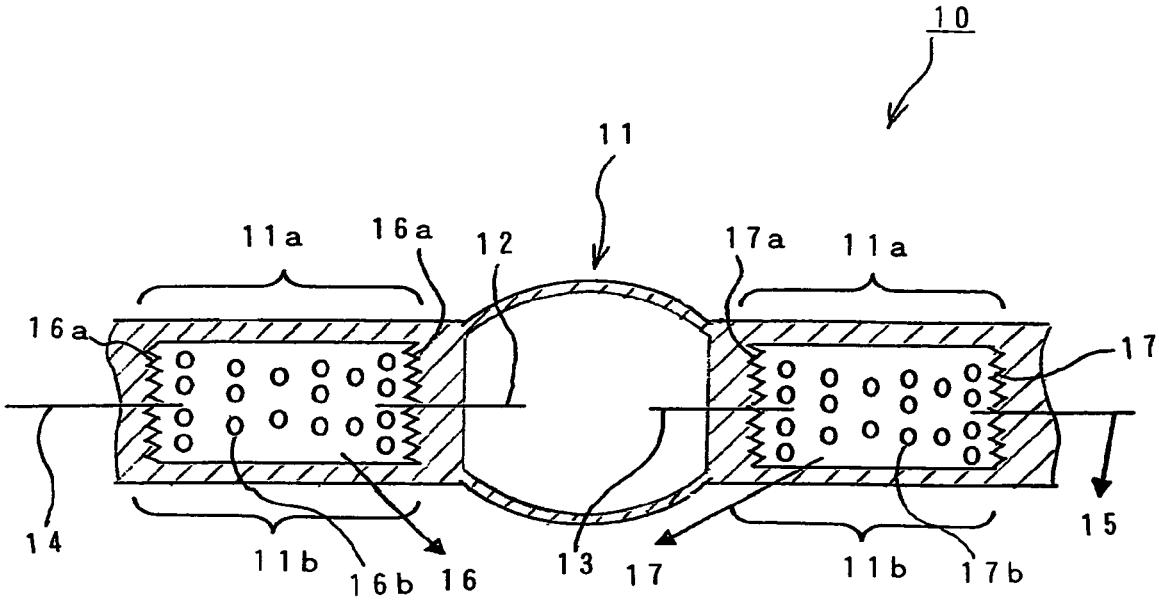
FIG. 1 is a schematic plan view showing a configuration of an embodiment of a discharge lamp made in accordance with the principles of the invention.

FIG. 1 shows a configuration of an embodiment of a discharge lamp made in accordance with the principles of the present invention. In FIG. 1, a metal halide lamp 10 can include a hollow glass tube bulb 11, a pair of discharge electrodes 12 and 13 arranged within the glass tube bulb 11, and metal foils 16 and 17 connecting the discharge electrodes 12 and 13 to externally extending lead wires 14 and 15.

The glass tube bulb 11 can be made, for example, of quartz glass, formed roughly in the form of a hollow sphere in the case of the illustration. At the same time, the glass tube bulb 11 can be provided with sealing portions 11*a* and 11*b* at both axial ends, and it is possible for mercury/metal halide, and/or other known discharge lighting materials, to be enclosed in the sealing portions 11*a* and 11*b* when these portions are sealed.

The discharge electrodes 12 and 13, can be made, for example, of a metal such as molybdenum, and can be arranged such that they are opposite to each other with a given spacing roughly at the center of the glass tube bulb 11. The lead wires 14 and 15, can also be made of a metal such as molybdenum, and can supply power to the discharge electrodes 12 and 13. The lead wires 14 and 15 are preferably connected electrically to the discharge electrodes 12 and 13 via the metal foils 16 and 17.

The metal foils 16 and 17, can be made, for example, of molybdenum foil, and can be sealed within the sealing portions 11*a* and 11*b* at both ends of the glass tube bulb 11. More specifically, the discharge electrode 12 and 13 and the lead wires 14 and 15 can be connected, for example, by welding, and the metal foils 16 and 17 can then be inserted into the sealing portions 11*a* and 11*b* when they are in an open state at both ends of the glass tube bulb 11. Then, the sealing portions 11*a* and 11*b* can respectively be softened by heating and crushed flat so as to hold the metal foils 16 and 17, thus sealing the metal foils 16 and 17.

This ensures hermetic sealing of the metal foils 16 and 17 within the sealing portions 11*a* and 11*b* of the glass tube bulb 11, thus maintaining the internal space of the glass tube bulb 11 hermetic. The metal foils 16 and 17 can function as power supply portions connecting the discharge electrodes 12 and 13 and the lead wires 14 and 15.

Depending on selection of material, the metal foils 16 and 17 can have an approximately 10-fold higher thermal expansion ratio as compared to the quartz glass that makes up the glass tube bulb 11. However, the metal foils 16 and 17 can be formed such that they are extremely thin, thus allowing hermetic sealing of the inside of the glass tube bulb 11.

The metal foils 16 and 17 can be provided with the stress alleviating portion formed as cuts 16*a* and 17*a* at the respective axial end edges, and holes 16*b* and 17*b* on the insides, as shown in FIG. 1.

Here, in the case of the illustration, the cuts 16*a* and 17*a* can be formed roughly in triangular shape at the respective end edges of the metal foils 16 and 17 and arranged adjacent to each other and continuously. More specifically, the cuts 16*a* and 17*a* can be, for example, approximately 0.1 to 0.2 mm in width.

On the other hand, the holes 16*b* and 17*b* can be arranged as appropriate in a distributed manner respectively on the insides of the metal foils 16 and 17. More specifically, the holes 16*b* and 17*b* can be, for example, about 0.1 to 0.2 mm in diameter and can be spaced about 0.3 to 0.5 mm apart.

The metal halide lamp 10 can be configured as described above, and at the time of manufacture, the metal foils 16 and 17 can have the discharge electrodes 12 and 13 and the lead wires 14 and 15 connected in advance, for example, by welding. These metal foils 16 and 17 can be inserted into the sealing portions 11*a* and 11*b* when the sealing portions are preferably formed in an open, hollow cylindrical form. At the same time, mercury/metal halide and rare gas (or other know discharge lamp gas or material) can be charged into the glass tube bulb 11, and the sealing portions 11*a* and 11*b* can be softened by heating and crushed flat so as to hold the metal foils 16 and 17. This allows the power supply portions including the metal foils 16 and 17, the discharge electrodes 12 and 13, and the lead wires 14 and 15 to be sealed within the sealing portions 11*a* and 11*b* of the glass tube bulb 11, with mercury/metal halide, etc. enclosed within the glass tube bulb 11, thus completing the metal halide lamp 10.

When a drive voltage is applied via the lead wires 14 and 15, the metal halide lamp 10 thus configured produces an electric discharge between the discharge electrodes 12 and 13, and in response thereto mercury/metal halide (or other material) sealed within the glass tube bulb 11 produces electromagnetic emissions, lighting up the lamp. Cuts 16*a* and 17*a* at the axial end edges of the metal foils 16 and 17 reduce the stress resulting from the difference in thermal expansion ratio between the metal foils 16 and 17 and the glass tube bulb 11. This makes it possible to suppress the occurence of cracks originating from the end edges of the metal foils 16 and 17 due to stress caused by temperature variations. In an experiment, no occurrences of cracks were observed even immediately following sealing of the sealing portions 11*a* and 11*b*.

The holes 16*b* and 17*b* that can be located within the metal foils 16 and 17 allow two portions of quartz glass, one making up the sealing portion 11*a* and the other sealing portion 11*b* each located on an opposite side of respective metal foils 16 and 17, to melt and merge, thus enhancing adhesion of the metal foils 16 and 17 to quartz glass in the sealing portions 11*a* and 11*b*. This construction can suppress occurrence of cracks around the metal foils 16 and 17 due to repetitive flashing over a long period of time. No occurrences of cracks were observed in an experiment conducted by inventors.

Figure 2:
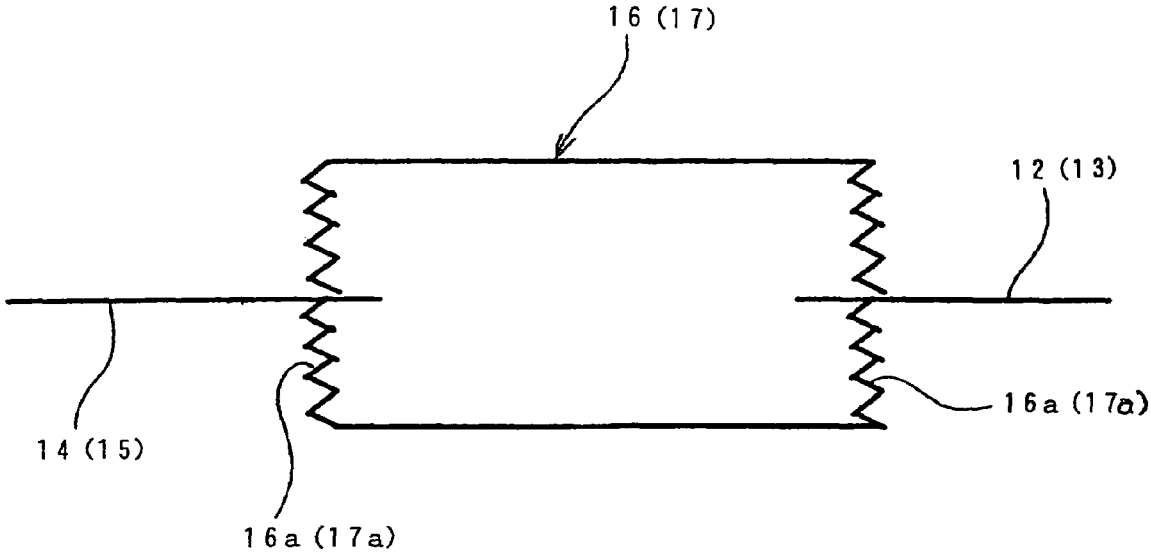
FIG. 2 is a partial plan view showing a portion of another embodiment of a discharge lamp made in accordance with the principles of the invention.

FIG. 2 shows metal foils 16 and 17 in accordance with another embodiment of the invention. In FIG. 2, the metal foil 16 (17) can be provided continuously with the triangular cuts 16*a* (17*a*) at the axial end edges. In this case, the metal foil 16 (17) may or may not be provided with holes on the inside.

This type of configuration can alleviate stress at the axial end edges of the metal foil 16 (17) with the cuts 16*a* (17*a*), thus suppressing the occurrence of cracks originating from the end edges of the metal foil 16 (17) due to stress caused by temperature variations.

Figure 3:
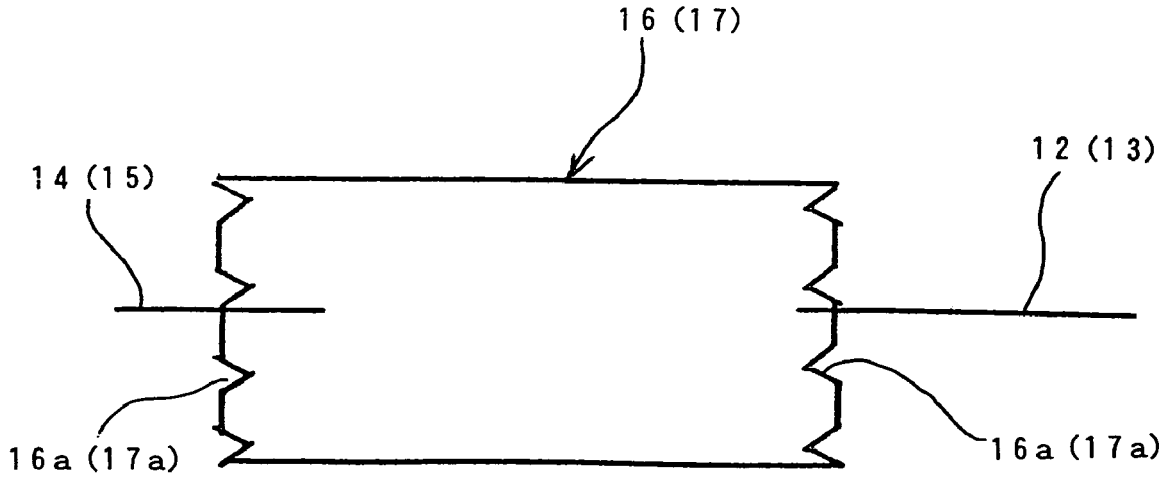
FIG. 3 is a partial plan view showing a portion of another embodiment of a discharge lamp made in accordance with the principles of the invention.

FIG. 3 shows metal foils 16 and 17 in accordance with another embodiment of the invention. In FIG. 3, the metal foils 16 (17) can be provided with triangular cuts 16*a* (17*a*) that are arranged apart from each other at the axial end edges. In this case, the metal foil 16 (17) is not necessarily provided with holes on the inside. This type of configuration also can alleviate stress at the axial end edges of the metal foil 16 (17) with the cuts 16*a* (17*a*), thus suppressing the occurrence of cracks originating from the end edges of the metal foil 16 (17) due to stress caused by temperature variations such as those that occur from repeated, general and/or prolonged use of the lamp, etc.

Figure 4:
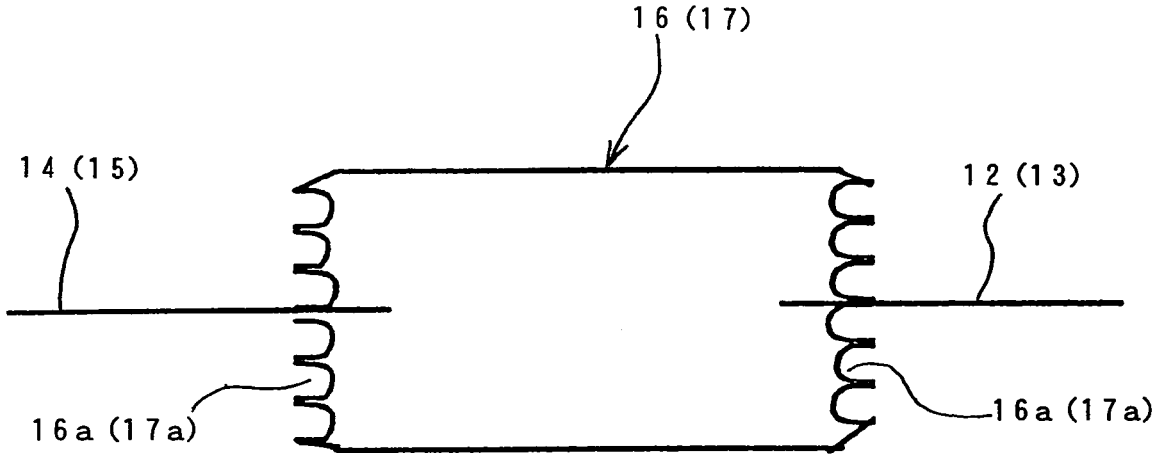
FIG. 4 is a partial plan view showing a portion of another embodiment of a discharge lamp made in accordance with the principles of the invention.

FIG. 4 shows metal foils 16 and 17 in accordance with another embodiment of the invention. In FIG. 4, the metal foils 16 (17) can be provided continuously with the semicircular cuts 16*a* (17*a*) at the axial end edges. In this case, the metal foil 16 (17) may or may not be provided with holes on the inside. This type of configuration can alleviate stress at the axial end edges of the metal foil 16 (17) with the cuts 16*a* (17*a*), thus suppressing the occurrence of cracks originating from the end edges of the metal foil 16 (17) due to stress caused by temperature variations.

Figure 5:
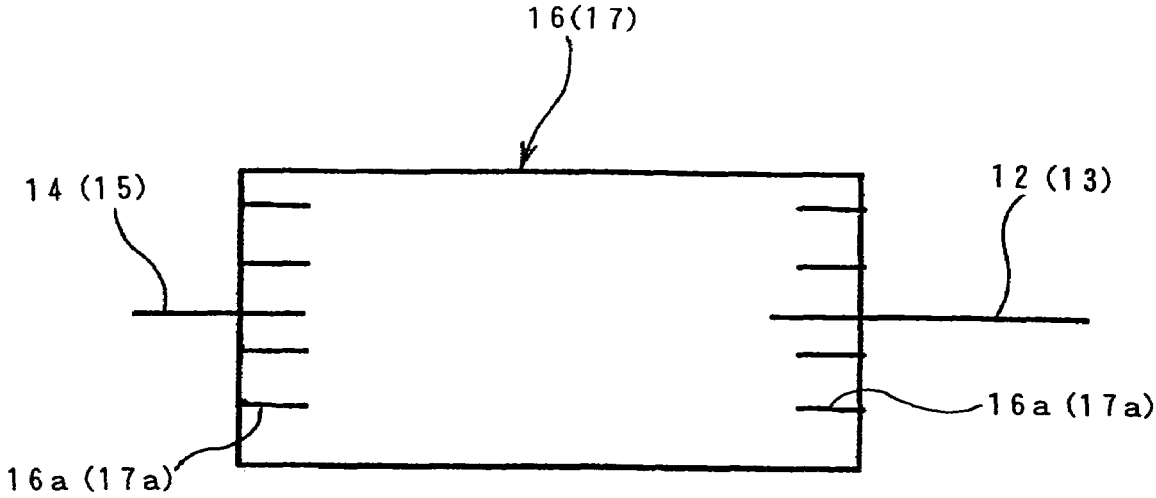
FIG. 5 is a partial plan view showing a portion of another embodiment of a discharge lamp made in accordance with the principles of the invention.

FIG. 5 shows metal foils 16 and 17 in accordance with another embodiment of the invention. In FIG. 5, the metal foils 16 (17) can be provided with linear cuts 16*a* (17*a*) that are arranged apart from each other at the axial end edges. In this case, the metal foil 16 (17) may or may not be provided with holes on the inside. This type of configuration also can alleviate stress at the axial end edges of the metal foil 16 (17) with the cuts 16*a* (17*a*), thus suppressing the occurrence of cracks originating from the end edges of the metal foil 16 (17) due to stress caused by temperature variations.

Figure 6:
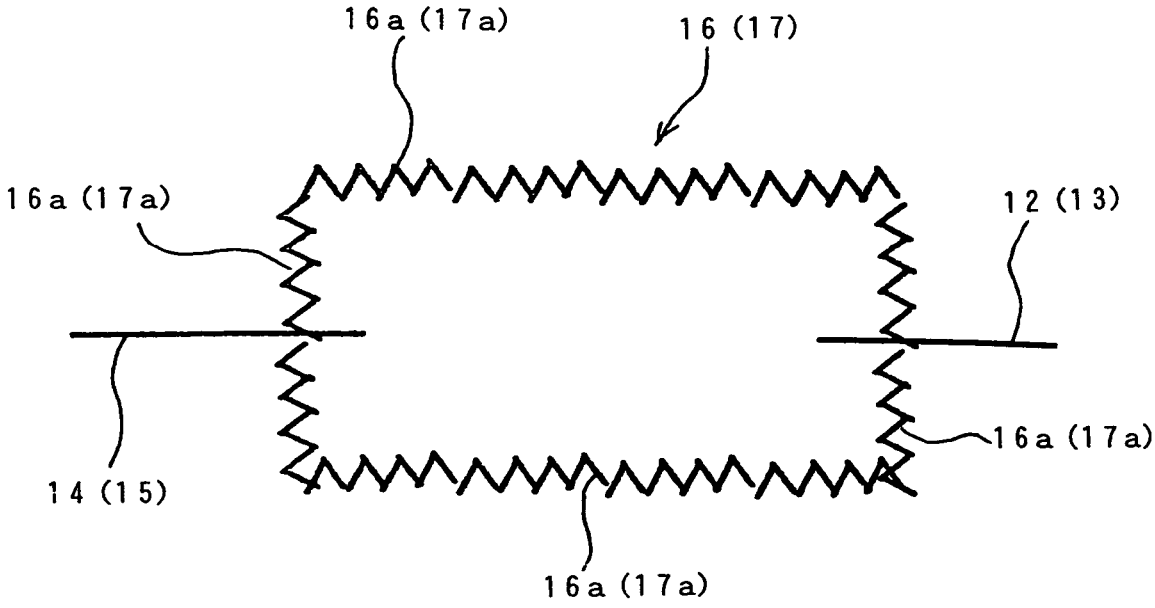
FIG. 6 is a partial plan view showing a portion of another embodiment of a discharge lamp made in accordance with the principles of the invention.

FIG. 6 shows metal foils 16 and 17 in accordance with another embodiment of the invention. In FIG. 6, the metal foils 16 (17) can be provided continuously with triangular cuts 16*a* (17*a*) at the axial end edges and both side edges. In this case, the metal foil 16 (17) may or may not be provided with holes on the inside. This type of configuration can alleviate stress at the axial end edges and both side edges of the metal foil 16 (17) with the cuts 16*a* (17*a*), thus suppressing the occurrence of cracks originating from the end edges and both side edges of the metal foil 16 (17) due to stress caused by temperature variations.

Figure 7:
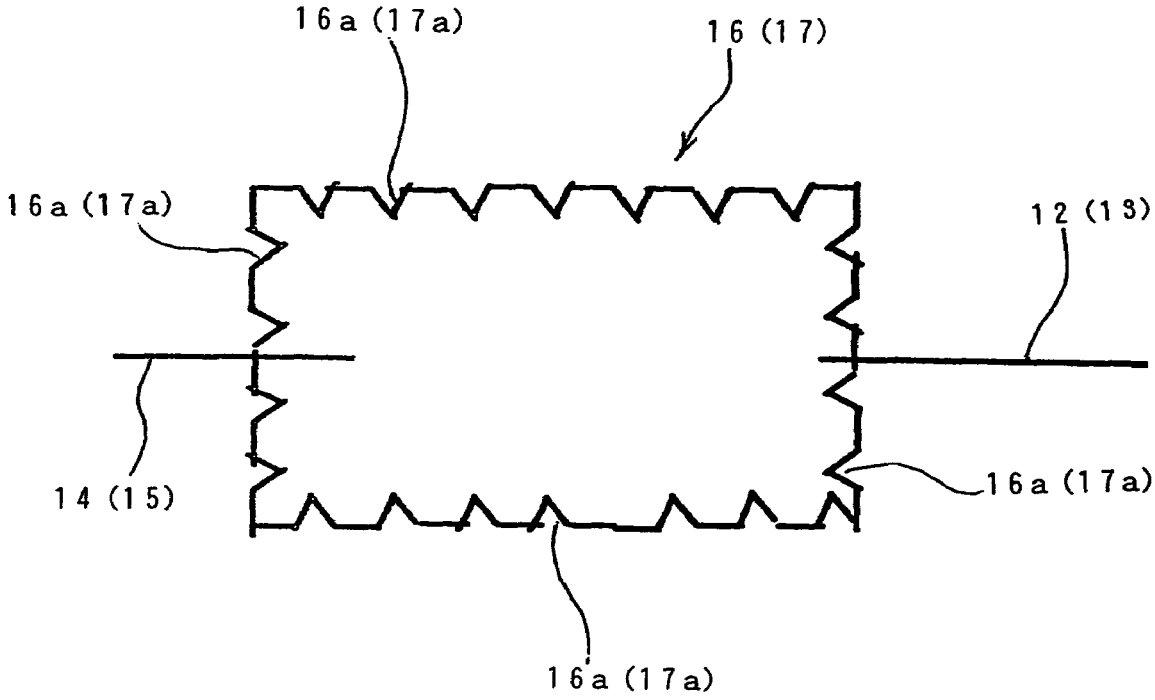
FIG. 7 is a partial plan view showing a portion of another embodiment of a discharge lamp made in accordance with the principles of the invention.

FIG. 7 shows metal foils 16 and 17 in accordance with another embodiment of the invention. In FIG. 7, the metal foils 16 (17) can be provided with triangular cuts 16*a* (17*a*) that are arranged apart from each other at the axial end edges and both side edges. In this case, the metal foil 16 (17) may or may not be provided with holes on the inside. This type of configuration also can alleviate stress at the axial end edges and both side edges of the metal foil 16 (17) with the cuts 16*a* (17*a*), thus suppressing the occurrence of cracks originating from the end edges and both side edges of the metal foil 16 (17) due to stress caused by temperature variations.

Figure 8:
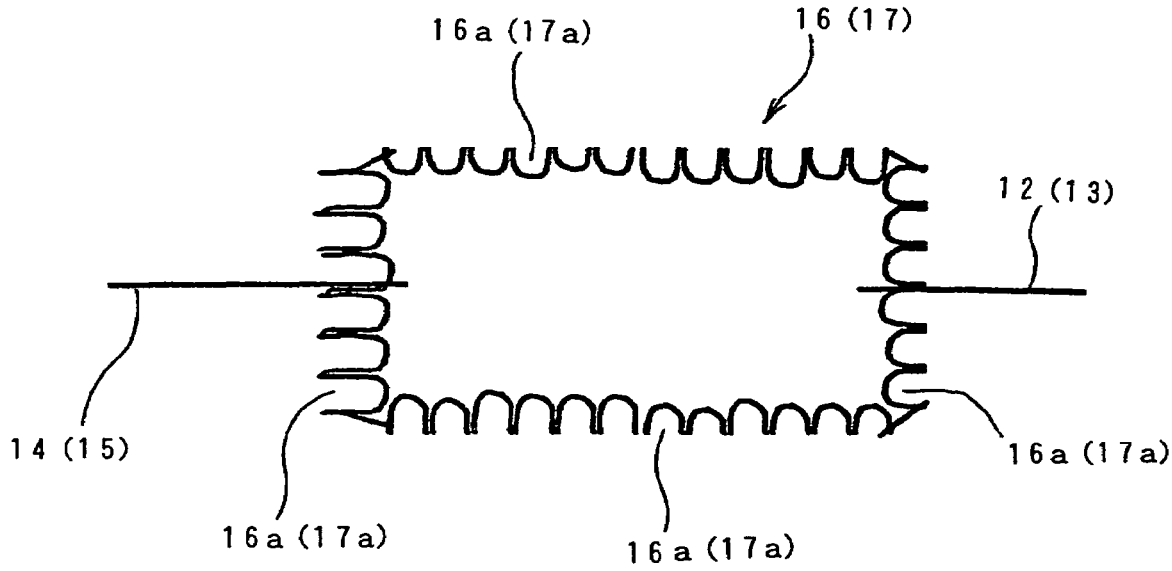
FIG. 8 is a partial plan view showing a portion of another embodiment of a discharge lamp made in accordance with the principles of the invention.

FIG. 8 shows metal foils 16 and 17 in accordance with another embodiment of the invention. In FIG. 8, metal foils 16 (17) can be provided continuously with the semi-circular cuts 16*a* (17*a*) at the axial end edges and both side edges. In this case, the metal foil 16 (17) may or may not be provided with holes on the inside. This type of configuration can alleviate stress at the axial end edges and both side edges of the metal foil 16 (17) with the cuts 16*a* (17*a*), thus suppressing the occurrence of cracks originating from the end edges and both side edges of the metal foil 16 (17) due to stress caused by temperature variations.

Figure 9:
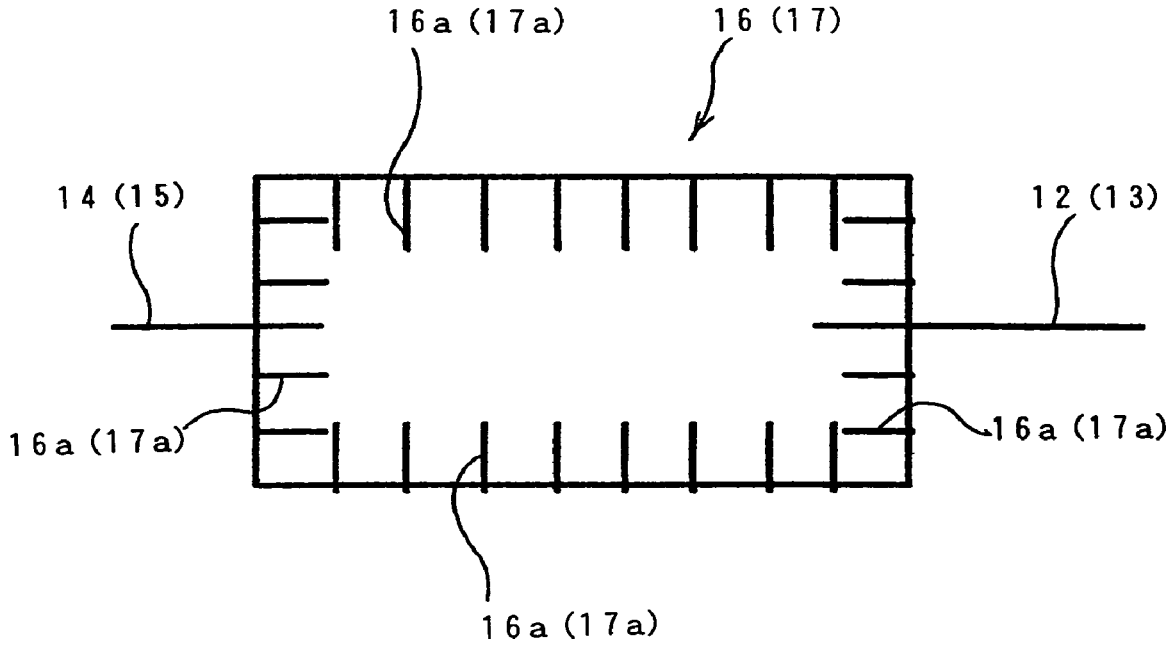
FIG. 9 is a partial plan view showing a portion of another embodiment of a discharge lamp made in accordance with the principles of the invention.

FIG. 9 shows metal foils 16 and 17 in accordance with another embodiment of the invention. In FIG. 9, the metal foils 16 (17) can be provided with linear cuts 16*a* (17*a*) that are arranged apart from each other at the axial end edges and both side edges. In this case, the metal foil 16 (17) may or may not be provided with holes on the inside. This type of configuration can alleviate stress at the axial end edges and both side edges of the metal foil 16 (17) by the cuts 16*a* (17*a*), thus suppressing the occurrence of cracks originating from the end edges and both side edges of the metal foil 16 (17) due to stress caused by temperature variations.

Figure 10:
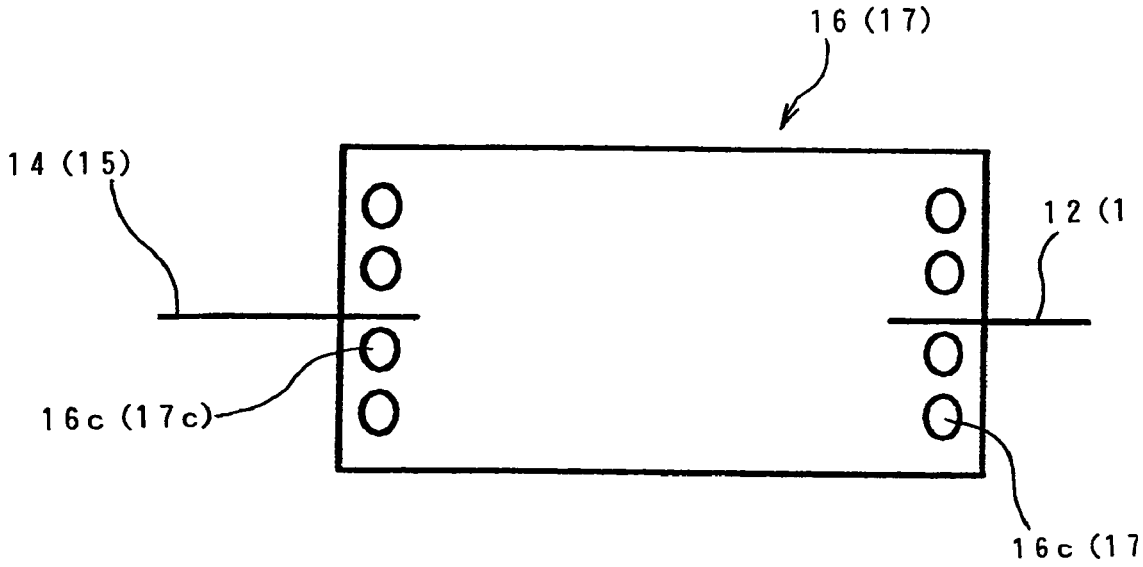
FIG. 10 is a partial plan view showing a portion of another embodiment of a discharge lamp made in accordance with the principles of the invention.

FIG. 10 shows metal foils 16 and 17 in accordance with another embodiment of the invention. In FIG. 10, the metal foils 16 (17) can be provided with circular holes 16*c* (17*c*) that are arranged apart from each other along the axial end edge regions. In this case, the metal foil 16 (17) may or may not be provided with cuts at the end edges. This type of configuration can alleviate stress at the axial end edges of the metal foil 16 (17) with the holes 16*c* (17*c*), thus suppressing the occurrence of cracks originating from the end edges of the metal foil 16 (17) due to stress caused by temperature variations.

Figure 11:
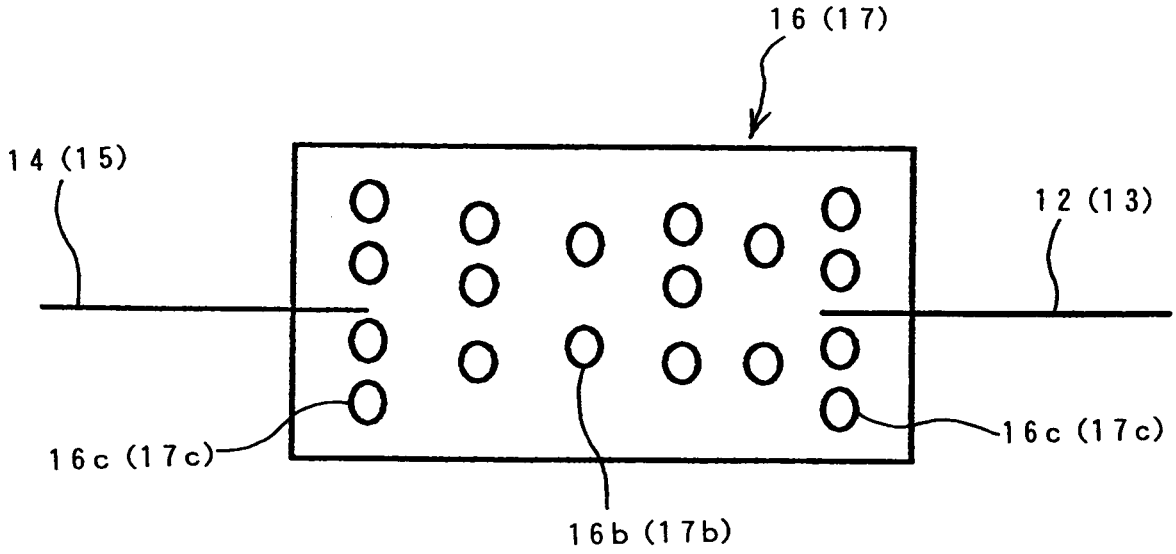
FIG. 11 is a partial plan view showing a portion of another embodiment of a discharge lamp made in accordance with the principles of the invention.

FIG. 11 shows metal foils 16 and 17 in accordance with another embodiment of the invention. In FIG. 1, the metal foils 16 (17) can be provided with circular holes 16*c* (17*c*) that are arranged apart from each other along the axial end edge regions, and circular holes 16*b* (17*b*) that are arranged apart from each other on the inside. This type of configuration can alleviate stress at the axial end edges of the metal foil 16 (17) with the holes 16*c* (17*c*) provided along the end edge regions, thus suppressing the occurrence of cracks originating from the end edges of the metal foil 16 (17) due to stress caused by temperature variations.

On the other hand, two portions of quartz glass, one making up the sealing portion 11*a* and the other making up the sealing portion 11*b*, that are opposite to each other on both sides of the metal foils 16 and 17, can melt and merge via the holes 16*b* and 17*b* provided on the insides of the metal foils 16 and 17, thus enhancing adhesion of the metal foils 16 and 17 to quartz glass in the sealing portions 11*a* and 11*b*. Therefore, this makes it possible to suppress the occurence of cracks around the metal foils 16 and 17 due to repetitive flashing over a long period of time.

Figure 12:
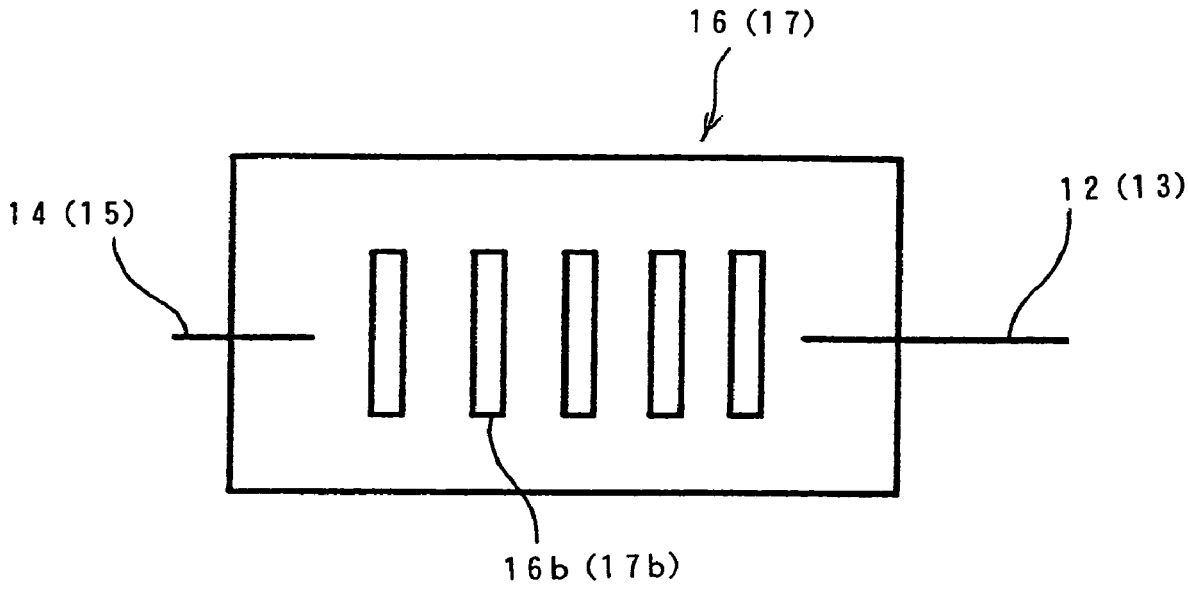
FIG. 12 is a partial plan view showing a portion of another embodiment of a discharge lamp made in accordance with the principles of the invention.
Figure 13:
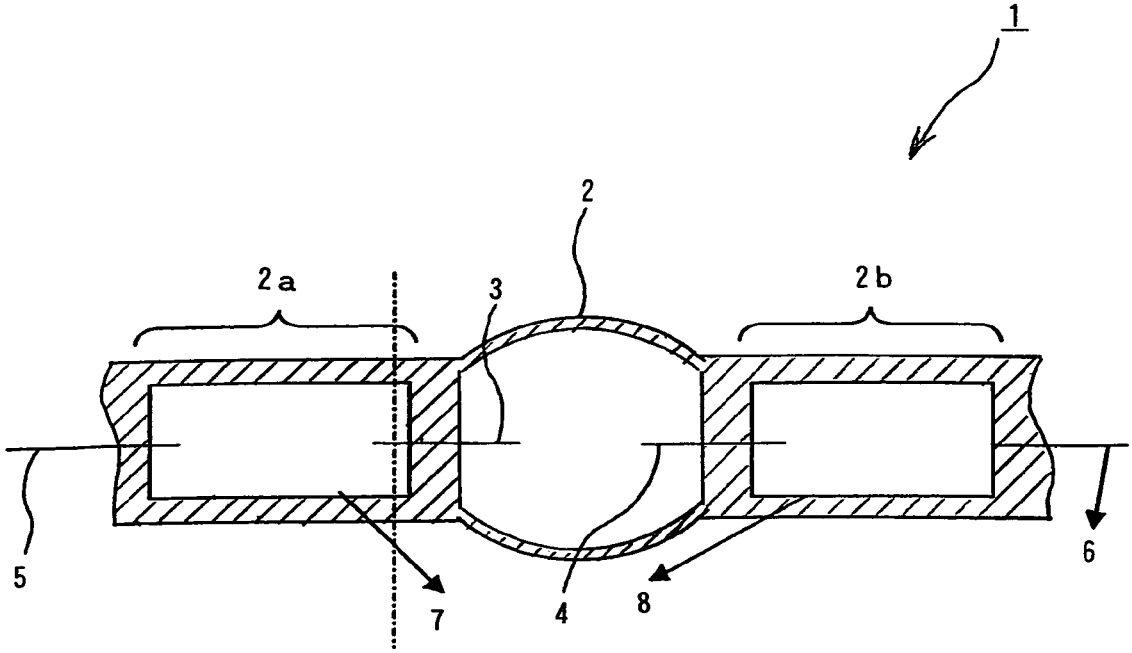
Fig. 13 Conventional Art
FIG. 13 is a schematic plan view showing an example of a conventional discharge lamp.
Figure 14:
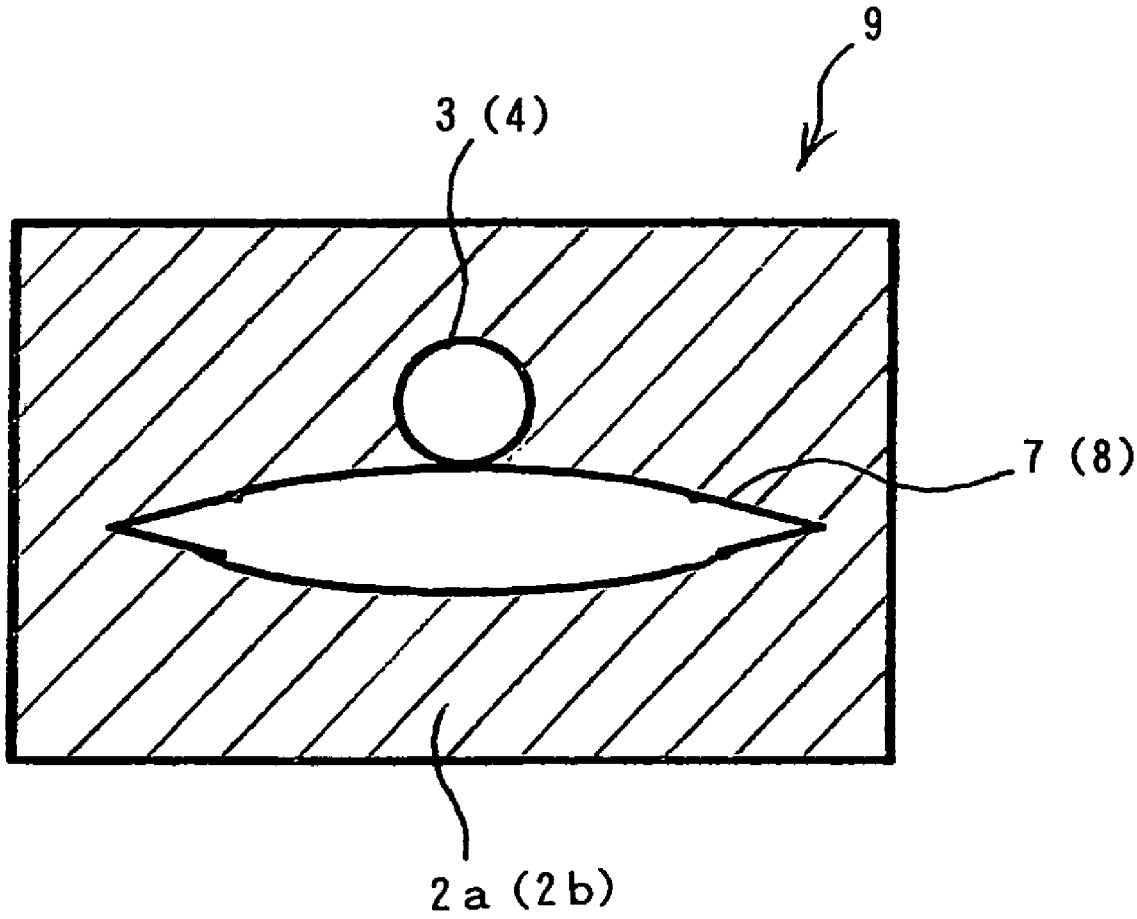
Fig. 14 Conventional Art
FIG. 14 is a sectional view of a portion of another example of a conventional discharge lamp.

FIG. 12 shows the metal foils 16 and 17 in accordance with another embodiment of the invention. In FIG. 12, the metal foils 16 (17) can be provided with long and narrow rectangular holes 16*b* (17*b*) that are arranged apart from each other and extend vertically in the axial direction on the inside.

This type of configuration allows melting and merging of two portions of quartz glass, one making up the sealing portion 11*a* and the other 11*b*, that are opposite to each other on both sides of the metal foils 16 and 17, via the holes 16*b* and 17*b* provided on the inside of the metal foil 16 (17), thus enhancing adhesion of the metal foils 16 and 17 to quartz glass in the sealing portions 11*a* and 11*b*. Therefore, this makes it possible to suppress the occurrence of cracks around the metal foils 16 and 17 due to repetitive flashing over a long period of time.

Thus, the metal halide lamp 10 can be provided with the stress alleviating portion made up of cuts 16*a* and 17*a* or the holes 16*b*, 16*c*, 17*b* and 17*c* at the end edges and/or on the insides of the metal foils 16 and 17. Thus, stress due to temperature variations or repetitive flashing over a long period of time, resulting from difference in thermal expansion ratio, for example, between molybdenum making up the metal foils 16 and 17 and quartz glass making up the glass tube bulb 11, can be alleviated with the stress alleviating portion.

Therefore, this makes it possible to suppress the occurrence of cracks originating from the end or side edges of the metal foils 16 and 17 due to the aforementioned stress, thus enhancing reliability of the metal halide lamp 10.

While in the above-described embodiments, the metal halide lamp 10, to which the invention is applied, has been described, the invention is not limited thereto, and it is apparent that the invention is applicable to lamps such as tungsten-halogen electric bulb, high-pressure discharge lamps, and other lamps in which metal foils or other similar structures are similarly sealed within the sealing portions of a bulb such as a glass tube bulb.

Thus, it is possible to provide a discharge lamp capable of reliably suppressing the occurrence of cracks around metal foils or other structures sealed within the sealing portions of a bulb such as a glass tube bulb.

The holes of the stress alleviating portion are disclosed above as being substantially circular or rectangular. However, it is also contemplated that the holes can be many other different shapes, including oval, polygonal, or even non-symmetrical and meandering. Likewise, the cuts can also take many various shapes while remaining within the scope of the invention, including square shaped, polygonal, s-shaped, oval, non-symmetrical shaped, and various other shapes.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A discharge lamp, comprising:

a bulb having a sealing portion located at an end of the bulb;

a pair of discharge electrodes arranged within the bulb;

a pair of externally extending lead wires located in the sealing portion; and at least one metal foil enclosed within the sealing portion of the bulb and connecting at least one of the discharge electrodes to at least one of the externally extending lead wires, wherein the at least one metal foil includes a first edge of the metal foil that is perpendicular to an elongated length of the lamp and a second edge of the metal foil that is perpendicular to the elongated length of the lamp, and the metal foil is provided with a stress alleviating portion that is configured to alleviate stress due to temperature variations, and the stress alleviating portion includes cuts extending beyond the first edge of the metal foil and beyond the second edge of the metal foil.

2. The discharge lamp according to claim 1, wherein the stress alleviating portion includes a plurality of holes provided at least in an axial end edge region of the metal foil.

3. The discharge lamp according to claim 2, wherein the stress alleviating portion is provided in a side edge region extending in an axial direction of the metal foil.

4. The discharge lamp according to claim 2, wherein the holes are substantially rectangular in shape.

5. The discharge lamp according to claim 1, wherein the stress alleviating portion includes a plurality of cuts provided at least along an axial end edge of the metal foil.

6. The discharge lamp according to claim 5, wherein the cuts are provided continuously so as to be in contact with adjacent cuts.

7. The discharge lamp according to claim 6, wherein the stress alleviating portion is provided in a side edge region extending in an axial direction of the metal foil.

8. The discharge lamp according to claim 5, wherein the cuts are provided discontinuously so as to have a given spacing between adjacent cuts.

9. The discharge lamp according to claim 8, wherein the stress alleviating portion is provided in a side edge region extending in an axial direction of the metal foil.

10. The discharge lamp according to claim 5, wherein the stress alleviating portion is provided in a side edge region extending in an axial direction of the metal foil.

11. The discharge lamp according to claim 5, wherein the cuts are shaped as triangles.

12. The discharge lamp according to claim 5, wherein the cuts are shaped to be substantially semi-circular.

13. The discharge lamp according to claim 1, wherein the stress alleviating portion is provided in a side edge region extending in an axial direction of the metal foil.

14. The discharge lamp according to claim 1, wherein the bulb is a glass tube bulb.

15. The discharge lamp according to claim 1, wherein the bulb includes two axial end regions each with a sealing portion, and the at least one metal foil includes a pair of metal foils, each metal foil located within the sealing portion at each axial end region of the bulb.

16. The discharge lamp according to claim 1, wherein the stress alleviating portion includes at least one of a plurality of cuts in a lateral side edge and a plurality of cuts in an end side edge.

17. The discharge lamp of claim 1, wherein the cuts are in the form of slits.

* * * * *